US009706838B2

(12) United States Patent
Shaw

(10) Patent No.: US 9,706,838 B2
(45) Date of Patent: Jul. 18, 2017

(54) AUTHORITY CONTROLLED CLOTHING LOCKER FOR RETAINING AND QUICKLY EXCHANGING INMATE CIVILIAN AND INCARCERATION (JUMP SUIT) CLOTHING SUCH AS PRIOR TO AND FOLLOWING COURT APPEARANCES

(71) Applicant: Raymond R. Shaw, Farmington Hills, MI (US)

(72) Inventor: Raymond R. Shaw, Farmington Hills, MI (US)

(73) Assignee: Raymond R. Shaw, Farmington Hills, MI (US)

( * ) Notice: Subject to any disclaimer, the term of this patent is extended or adjusted under 35 U.S.C. 154(b) by 0 days.

(21) Appl. No.: 15/063,009

(22) Filed: Mar. 7, 2016

(65) Prior Publication Data

US 2016/0255954 A1 Sep. 8, 2016

Related U.S. Application Data

(60) Provisional application No. 62/129,081, filed on Mar. 6, 2015.

(51) Int. Cl.
*A47B 61/00* (2006.01)
*A47B 61/06* (2006.01)
(Continued)

(52) U.S. Cl.
CPC ..... *A47B 61/06* (2013.01); *B65D 5/4208* (2013.01); *B65D 85/18* (2013.01); *B65D 85/185* (2013.01); *B65D 5/10* (2013.01); *B65D 5/4204* (2013.01)

(58) Field of Classification Search
CPC ..... A47B 61/06; B65D 85/18; B65D 85/185; B65D 5/10; B65D 83/0088; B65D 5/4208; B65D 2571/0066; B65D 5/4204; B65D 5/5021
USPC ..... 206/279, 289, 287, 278, 299, 806, 288, 206/282, 292, 300, 772, 773, 290, 283, 206/284, 285; 312/259; 223/87; 229/122, 117.15
See application file for complete search history.

(56) References Cited

U.S. PATENT DOCUMENTS 2,016,520 A * 10/1935 Short ..... A45C 7/0077 190/107
2,022,941 A * 12/1935 Rottman ..... A47G 25/54 206/299
(Continued)

FOREIGN PATENT DOCUMENTS

EM 0235062 A1 9/1987
EM 0350570 A2 1/1990
FR 2519611 A1 7/1983

*Primary Examiner* — Daniel J Troy
*Assistant Examiner* — Hiwot Tefera
(74) *Attorney, Agent, or Firm* — Dinsmore & Shohl LLP

(57) ABSTRACT

An authority controlled clothing locker including a generally elongated and three dimensional rectangular body adapted for holding a set of clothing, including footwear. A door is hingedly secured along a forward edge of the body and is releasably engaged over an open front of the locker. A hanger is adapted to being supported relative to a top underside location of the open interior, the body further including a hanging aperture configured within an upper most lip of the body, the aperture further adapted for suspending the body from a horizontally extending pole, bar or the like.

14 Claims, 6 Drawing Sheets

(51) Int. Cl.

| | |
|---|---|
| ***B65D 5/42*** | (2006.01) |
| ***B65D 85/18*** | (2006.01) |
| *B65D 5/10* | (2006.01) |

(56) References Cited

U.S. PATENT DOCUMENTS 2,561,053 A * 7/1951 Fallert ..... A47G 25/54 206/291
2,672,274 A * 3/1954 Crane ..... B65D 5/0254 206/773
2,752,032 A * 6/1956 Fish ..... B65D 85/185 206/279
3,035,688 A * 5/1962 Field ..... B65D 85/185 206/279
3,565,242 A * 2/1971 Konkoli ..... B65D 85/18 206/290
3,625,411 A * 12/1971 Cote ..... B65D 5/4204 206/316.1
3,659,704 A * 5/1972 Collura ..... B65D 5/4208 206/288
3,690,523 A * 9/1972 Link ..... B65D 5/42 206/806
3,708,109 A * 1/1973 Rosenburgh, Jr. ..... B65D 5/705 229/122
3,841,478 A * 10/1974 Wells ..... B65D 33/14 206/335
4,098,399 A * 7/1978 Bethune ..... B65D 85/18 206/288
4,111,300 A * 9/1978 Partain ..... B65D 85/185 206/280
4,318,472 A * 3/1982 Nauheimer ..... B65D 5/5021 206/284
5,348,148 A * 9/1994 Lancaster ..... B65D 5/10 206/279
5,458,233 A * 10/1995 Herrin ..... B65D 5/4208 229/117.14
5,499,484 A * 3/1996 Herrin ..... B65D 5/4208 53/458
5,887,782 A * 3/1999 Mueller ..... B65D 5/0227 229/117
6,279,819 B1 * 8/2001 Schultz ..... B65D 5/4208 206/806
7,866,769 B2 1/2011 Ahlgrim et al.
8,708,433 B2 4/2014 Ahlgrim et al.
2006/0096821 A1 5/2006 McKaba
2007/0257096 A1 * 11/2007 Coltri-Johnson .... B65D 5/4295 229/242

* cited by examiner

AUTHORITY CONTROLLED CLOTHING LOCKER FOR RETAINING AND QUICKLY EXCHANGING INMATE CIVILIAN AND INCARCERATION (JUMP SUIT) CLOTHING SUCH AS PRIOR TO AND FOLLOWING COURT APPEARANCES

CROSS REFERENCE TO RELATED APPLICATIONS

The present application claims the priority of U.S. Ser. No. 62/129,081 filed Mar. 6, 2015, the contents of which is incorporated herein in its entirety.

FIELD OF THE INVENTION

The present invention discloses an authority controlled clothing locker which is configured for retaining and quickly exchanging both civilian and incarceration apparel, such as for use by inmates prior to and following court appearances. The locker exhibits a generally elongated and three dimensional rectangular construction for holding a set of clothing, including footwear which can be supported upon a bottom surface of the locker. A door can be hingedly secured along a forward edge of the body and is resistively secured by opposing pluralities of hook and loop fasteners or the like to seal over an open front of the locker exhibited when the door is swung open. A hanger can be supported along a top underside location of the open interior for supporting clothing within the interior of the locker. The locker further includes an upper most hanging aperture, such as which allows the locker to be suspended from a horizontally extending pole, bar or the like.

DESCRIPTION OF THE BACKGROUND ART

The prior art is documented with examples of clothing containing or supporting devices. A first example of this is set forth in FR 2 519 611 which teaches a package which is applicable both for transporting and storage of articles.

US 2006/0096821, to McKaba, teaches a portable container such as, for example, a suitcase, having a compartment and an extendable organizer disposed within the compartment. The extendable organizer is preferably made of a lightweight material such as nylon. The organizer, when extended, presents a plurality of horizontal, flat, collapsible shelves providing storage compartments, the shelves being vertically separated by a desired distance. The organizer, can be of any particular configuration, including length, width and height, consistent with the dimensions of the compartment within the container. In a preferred embodiment the organizer extends to approximately 30 inches in height and collapses, preferably in an accordion-like fashion, to pack down to a height of less than about one inch when empty.

SUMMARY OF THE PRESENT INVENTION

The present invention discloses an authority controlled clothing locker including a generally elongated and three dimensional rectangular body adapted for holding a set of clothing, including footwear. A door is hingedly secured along a forward edge of the body and is releasably engaged over an open front of the locker. A hanger is adapted to being supported relative to a top underside location of the open interior, the body further including a hanging aperture configured within an upper most lip of the body, the aperture further adapted for suspending the body from a horizontally extending pole, bar or the like.

Additional features include the body having a flattened blank construction including a plurality of hinged panels defining each of a front, back, top, bottom and sides. The top further exhibits first and second pairs of side and end flaps which are assembleable in order to define the upper most lip. The hanging aperture further includes spaced apart extending edge surfaces defined in each of vertical and horizontal connecting fashion.

Yet additional features include hook and loop fastener portions for releasably securing the door to the body. Also provided are ventilation apertures configured in extending fashion along the sides of the body.

BRIEF DESCRIPTION OF THE DRAWINGS

Reference will now be made to the attached drawings, when read in combination with the following detailed description, wherein like reference numerals refer to like parts throughout the several views, and which.

DETAILED DESCRIPTION OF THE PREFERRED EMBODIMENTS

Figure 1:
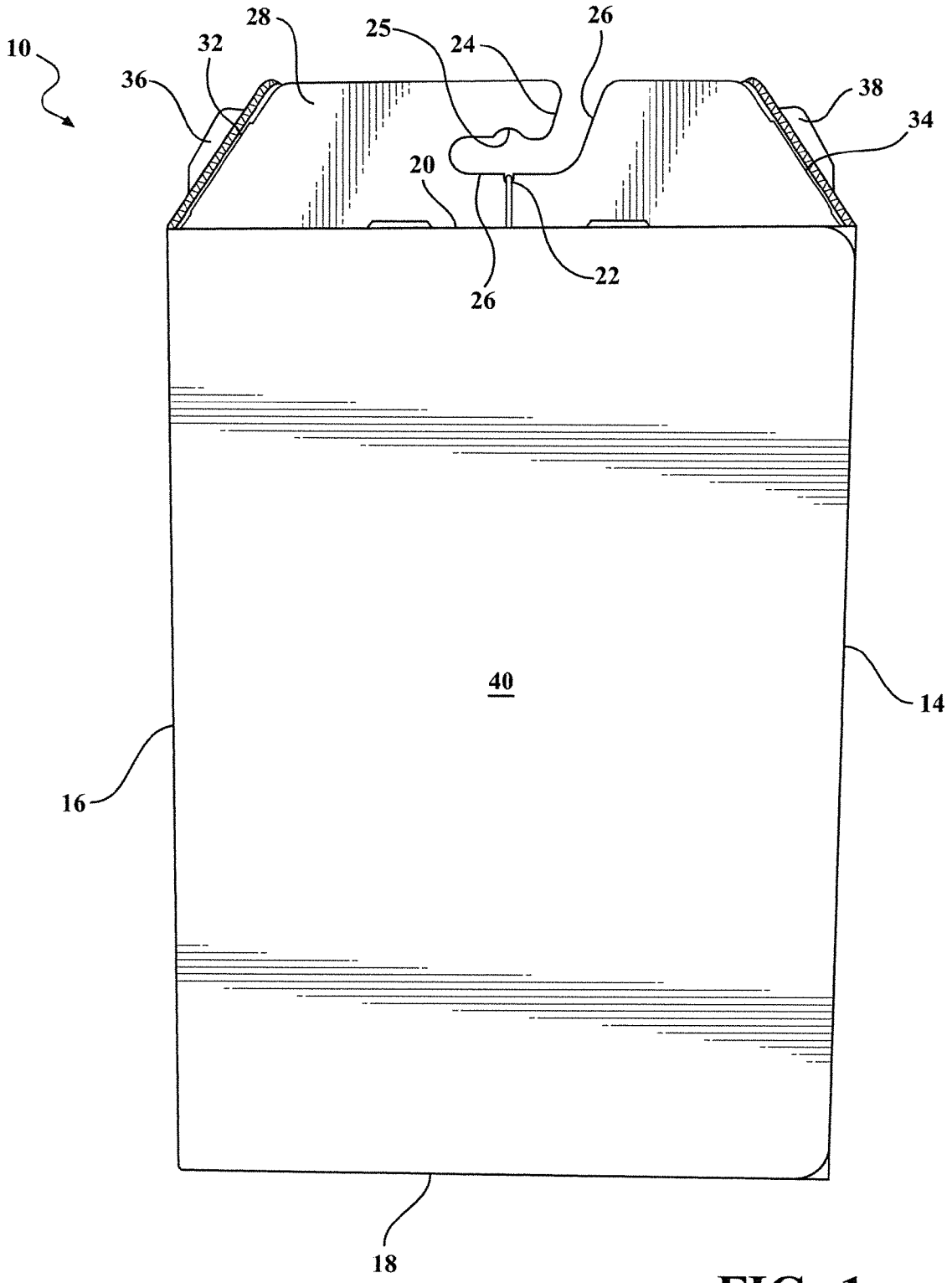
FIG. 1 is a plan view of the clothing locker according to one non-limiting variant of the present invention.

As previously described, the present invention discloses an authority controlled clothing locker, generally depicted at 10 in FIG. 1, which is configured for retaining and quickly exchanging both civilian and incarceration apparel, such as for use by inmates prior to and following court appearances. The advantage of the clothing locker is that it facilitates efficient transport of such as non-incarceration apparel (such as a suit), which the accused can don prior to a court appearance, following which the apparel is replaced within the locker and the incarcerated changed back into specified prison garb.

As will be also described, additional desired aspects of the clothing change locker include each of its transportability, the ability to tag information labels or the like such as to the exterior surface of the locker (this including arrest information or the like as well as other identifying indicia), and the ability to obscure the interior contents (desirable in many instances) which is often not possible in the use of prior art articles such as flexible garment bags and the like. The ability of the rigid and corrugated paperboard container to be self-supporting on a level surface is another advantage not possible with flexible garment bags and such. The additional advantage of the rigid self-supporting locker to support a pair of civilian shoes, such as upon a rigid interior bottom of the locker enclosure, is another feature not provided for by a flexible garment bag.

Figure 3:
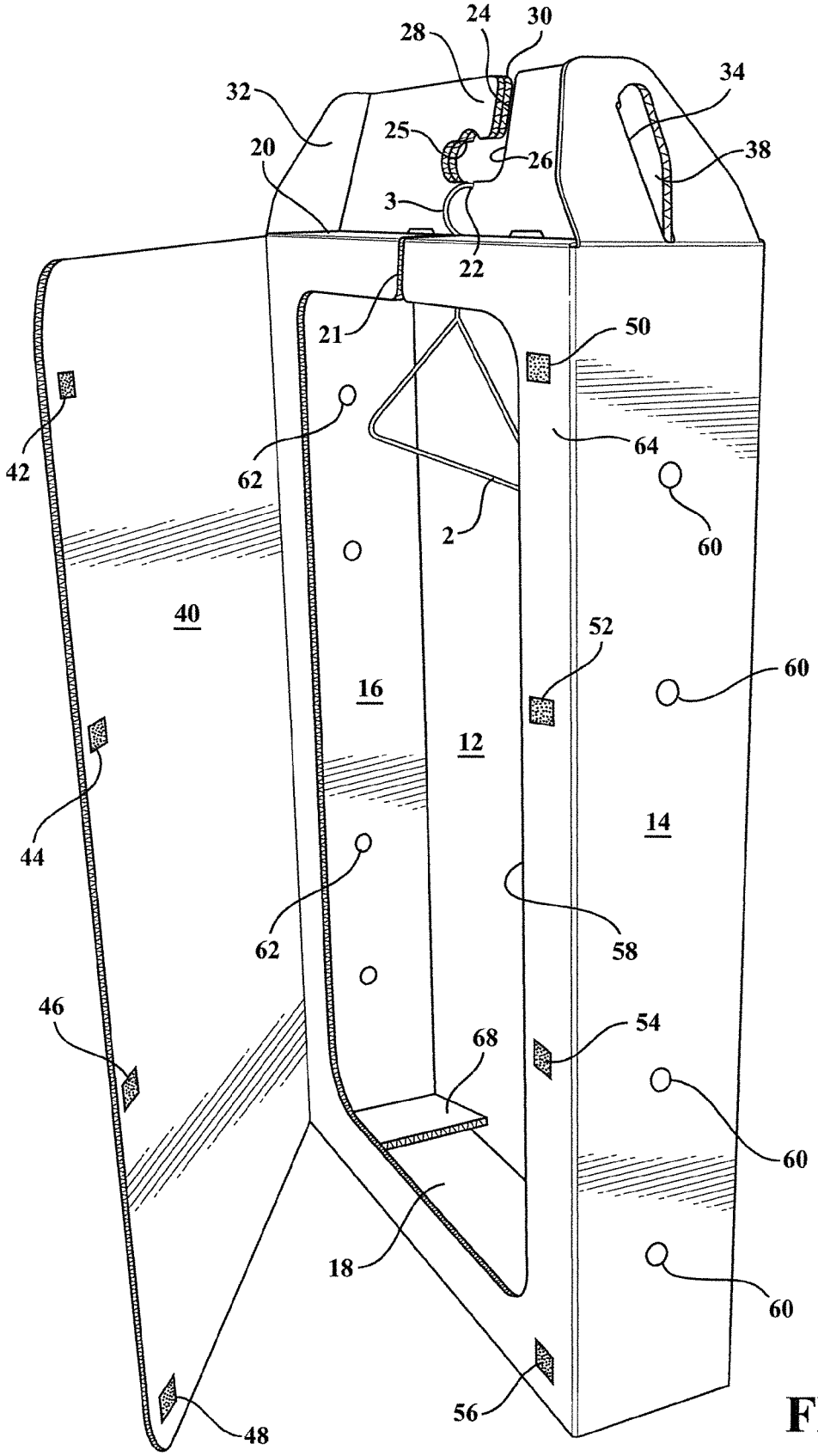
FIG. 3 is a side perspective of the clothing locker and further illustrating its interior depth dimensions along with the provision of ventilation apertures extending along opposite sides of the locker.
Figure 5:
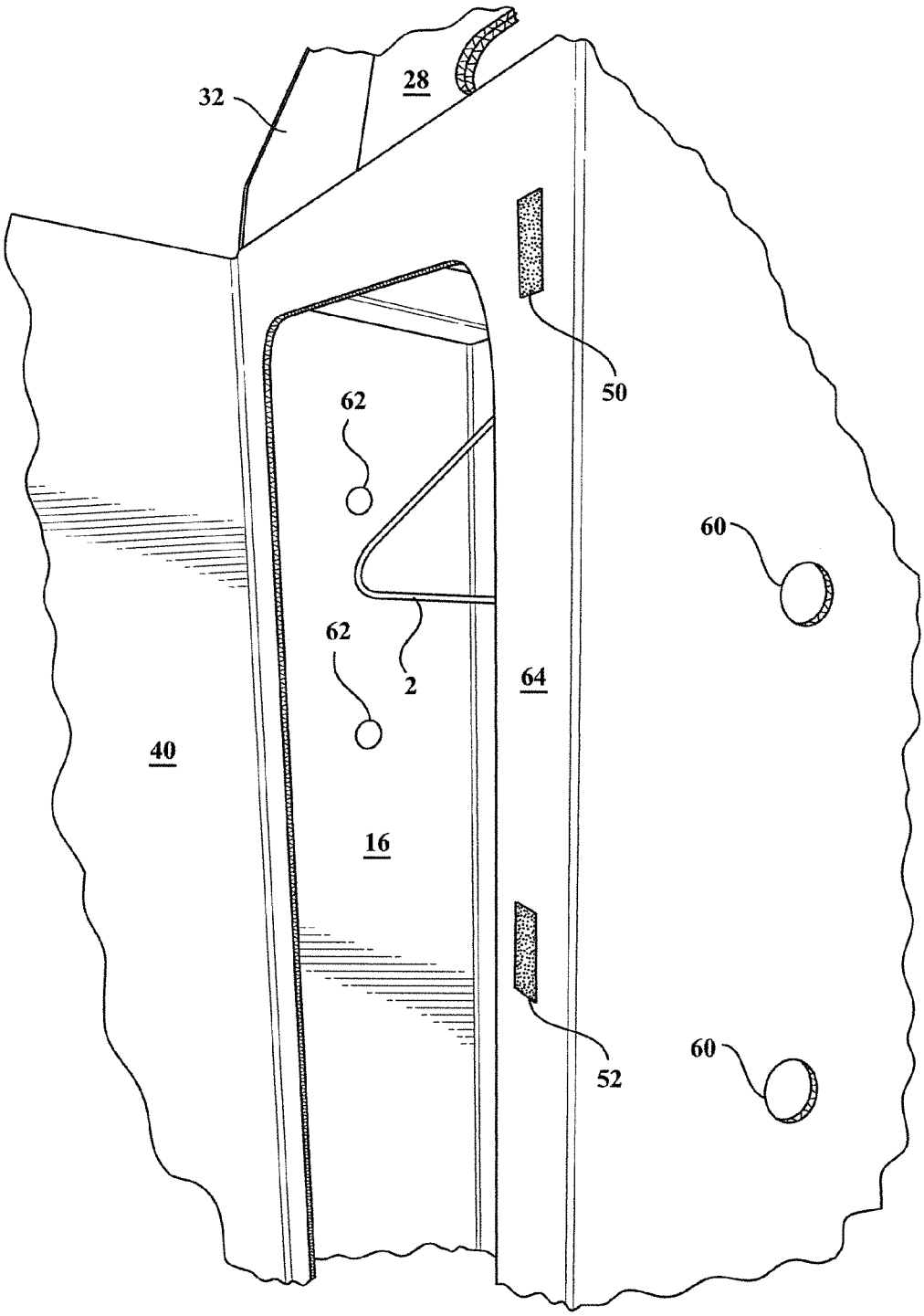
FIG. 5 is a further side perspective similar to FIG. 3.

As shown, the locker in the illustrated embodiment is constructed of a corrugated paperboard material exhibiting the necessary properties of strength and durability and exhibits a generally elongated and three dimensional rectangular construction with a base 12, sides 14 and 16, bottom 18 and a top 20. The dimensioning of the clothing locker 10 is such that it is capable of holding or supporting a set of clothing (not shown), and such as which are suspended from a conventional hanger 2. As further shown, the bottom interior surface 18 of the locker (see as best depicted in FIG. 3) is capable of supporting a pair of shoes or other footwear associated with the change of clothes.

Figure 2:
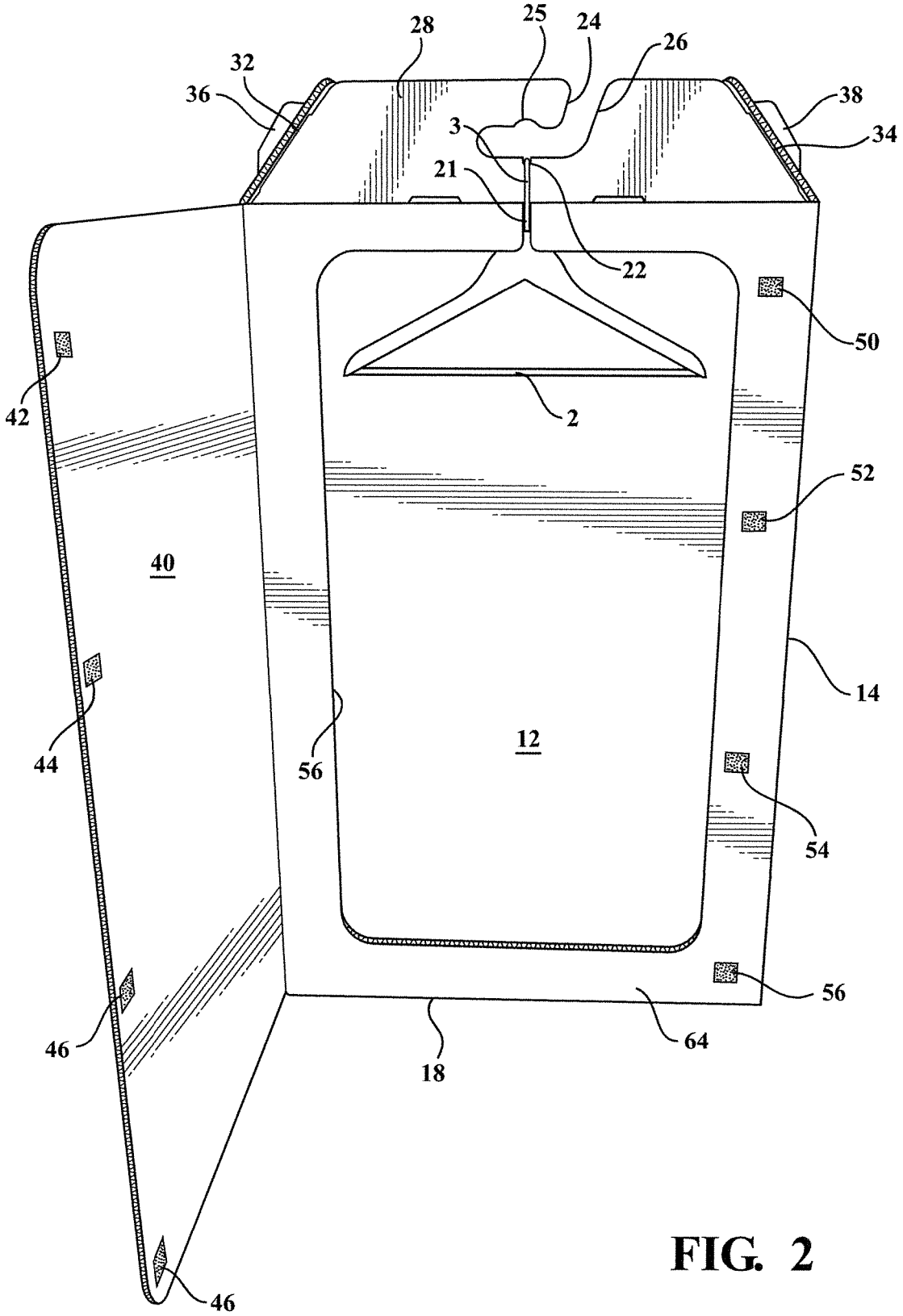
FIG. 2 is a succeeding view illustrating the clothing locker illustrating the door in an open position in order to reveal a cloth retaining interior including an upper edge supported clothing hanger as well as the opposing pluralities of hook and loop fasteners.

An upper hooked end 3 of the hanger 2 can extend through a slot 21 located at the upper end of the locker 10 and in order to engage a notched location 22 defined in an underneath surface of a hanging aperture. Reference is further made to opposing and inwardly extending surfaces 24 and 26 in FIG. 2 which define an insertion passageway configured in successively vertical and horizontal configured fashion into an upper support lip associated with the locker, this in order to define a support location, see at 25 associated with underside of horizontal extending location for passageway 24, and for suspending the locker 10 from such as a horizontal extending pipe, bar or the like, with the notch 22 being configured in an interior horizontal surface location of the selected passageway extending surface 26.

Figure 7:
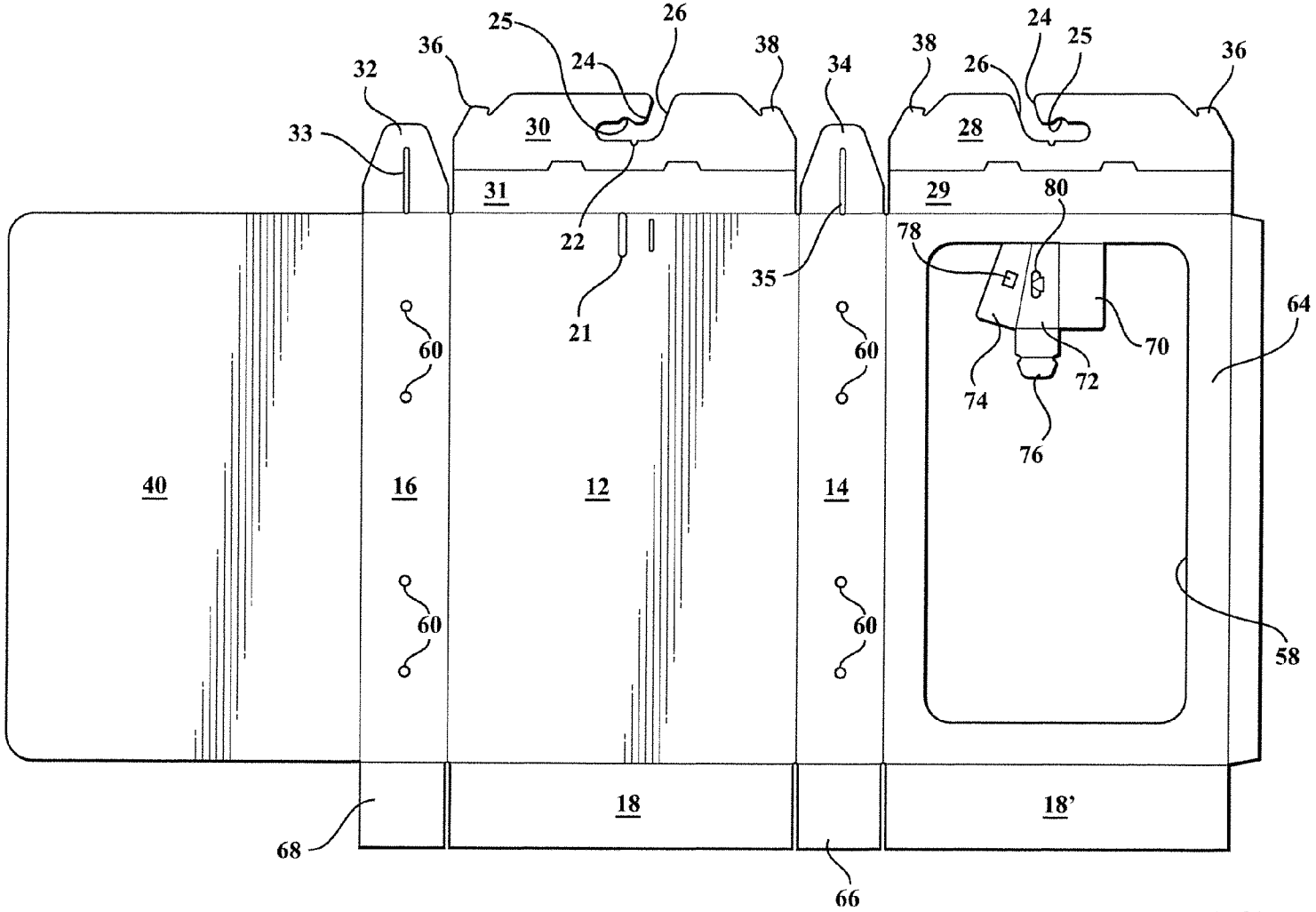
FIG. 7 is a plan view of a blank forming the clothing locker of the present invention.

For purposes of ease of illustration the dual sandwiched nature of the upper sides, flaps and handholds is best shown in the flattened blank configuration of FIG. 7, with the identical components associated with the front and back extending sides of the blank being identically referenced for purposes of the front and rear of the body. It is also understood that the hanging aperture defined in the upper lid panels can be internal only without access to the exterior edge as shown at 24/26. Such an internal aperture can exhibit any of a circular polygonal or elongated slot shaped defined within an interior each of the upper opposing foldable panels.

As further shown, the support lip as described above is constructed from side 28/30 and end 32/34 pairs of flaps (see also blank construction of FIG. 7), these being assembled in the manner shown to provide an upper end rigid support. As further shown, the upper support lip side flaps further include lower connecting portions 29 and 31, from which the upper or main side flaps 28/30 extend.

As again further best shown in the blank illustration of FIG. 7, the provision of vertical slots 33 and 35 in the end flaps 32 and 34 receive aligning pairs of configured corner edge locations (at 36 and 38) of the sandwiched top side portions 28 and 30 and, in combination with angling of the top portions 28/30 at ninety degrees relative to the supporting base portions 29/31, allow the folding over of the end flaps 32/34 in a manner which retains the flaps over the inner notched edges associated with the corner locations 36/38 and which further allows for carry-ability of the enclosure upon mating the identically configured upper extending sides and handle cutouts projecting from the front and rear upper edges of the three dimensionally configured and assembleable locker enclosure.

A door 40 can be hingedly secured along a forward edge of the body and is resistively secured by opposing pluralities of hook and loop fasteners, shown at 42, 44, 46 and 48 located in vertically spaced fashion along an inside outermost extending surface of the door 40 and which selectively mate with additional aligning hook and loop (Velcro®) fasteners 50, 52, 54 and 56 configured upon an exterior face of the locker body 10 at locations proximate an inner perimeter extending surface 58 establishing an open and structurally supported front of the locker exhibited when the door is swung open. Also best shown in FIG. 3, the side perspective of the clothing locker best illustrates its interior depth dimensions, this along with the provision of ventilation apertures, see individual pluralities 60 and 62 extending along each of the opposite sides 14 and 16 of the locker body 10.

Figure 4:
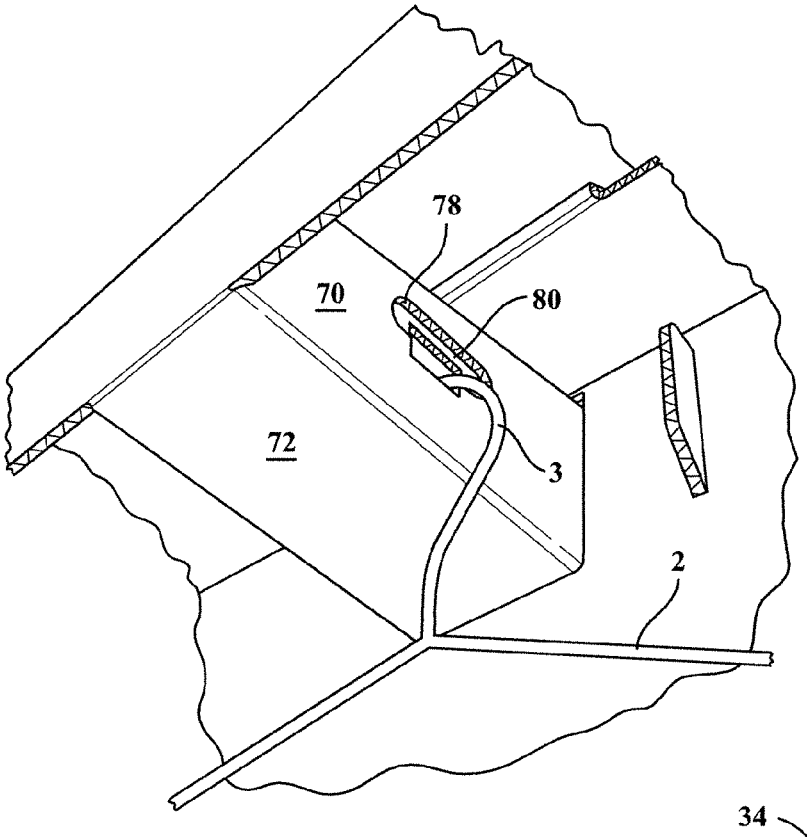
FIG. 4 is an interior and underside perspective of one variant of the clothing locker and which illustrates a structurally supported underside portion for receiving an upper most hook inserting portion of the hanger.
Figure 6:
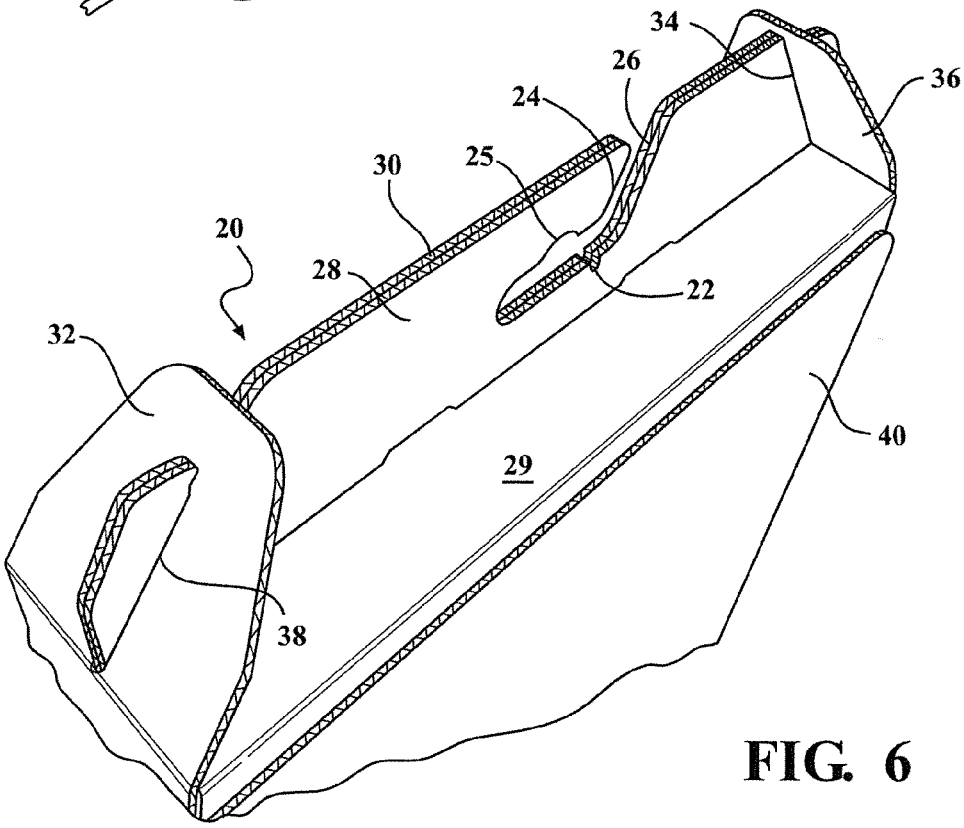
FIG. 6 is a top perspective of the clothing locker and better illustrating the pluralities of side and end flaps for structurally assembling the locker and for providing the uppermost configured suspension aperture.

FIG. 4 is an interior and underside perspective of one variant of the clothing locker and which illustrates a structurally supported underside portion for receiving an upper most hook inserting portion of the hanger 2. This is also referenced in the blank configuration of FIG. 7 which includes folded hinged portions 70/72/74, an end flap 76 extending from the intermediate portion 72 and providing for structural 3D assembly so that aligning insertion slots 78 and 80 provide for receipt of the upper hooked end of the hanger 2 in a fashion alternate to that depicted in FIGS. 1-3.

In combination with the assembleable blank illustration of FIG. 7, the bottom includes first 18 and second 18' overlapping flaps extending from both the front (depicted by perimeter extending surface 64 surrounding the inner perimeter edge 58 along with the rear hinged surface 12). Additional end flaps 66 and 68 are shown in FIG. 7 and which project from bottom edges of the side panels 14 and 16 (opposite the top end inter-engaging flaps 32 and 34).

Without limitation, the clothing locker 10 can exhibit other shapes, material constructions or the like without departing from the scope of the invention. It is also envisioned that evidence tape (not shown) or the like can be used between the door and hook and loop fastener engaging side of the body to confirm when the contents of the locker have been accessed.

Having described my invention, other and additional preferred embodiments will become apparent to those skilled in the art to which it pertains, and without deviating from the scope of the appended claims.

I claim:

1. An authority controlled locker adapted for holding a set of clothing including footwear, said locker comprising:

a multi-sided and foldable blank construction which is assembleable into a rigid self-supporting three dimensional rectangular body, said blank exhibiting a plurality of hinged panels corresponding to each of a front panel, a back panel, a top panel, a bottom panel and a pair of height extending side panels;

said front panel further including an inner perimeter extending edge separating an outer frame portion with an access opening to an interior of said assembled body;

a door hingedly secured along an extending edge of a selected one of said height extending side panels and, upon assembly of said body, being releasably engaged over said front panel in order to cover the access opening;

a hanger adapted to being supported relative to a top structurally supporting underside location of the open interior, said structural underside further including plurality of folded inter-hinged and assembleable portions projecting from a top location of said inner perimeter extending edge in said front panel, upon assembly of said inter-hinged and assembleable portions, an insertion slot being defined in one of said inter-hinged portions which is adapted to receive an upper hooked end of the hanger;

said body further including a hanging aperture configured within an upper most lip of said body, said aperture adapted for suspending said body from a horizontally extending pole; and said door being opened and closed with said body in either of bottom supported or suspended positions.

2. The clothing locker as described in claim 1, wherein said top panel further comprising first and second pairs of side and end flaps assembleable in order to define said upper most lip.

3. The clothing locker as described in claim 2, said hanging aperture further including spaced apart extending edge surfaces, each edge surface having vertical and horizontal connecting portions.

4. The clothing locker as described in claim 1, further comprising hook and loop fastener portions for releasably securing said door to said body.

5. The clothing locker as described in claim 1, further comprising ventilation apertures along said side panels of said body.

6. An authority controlled clothing locker, comprising:

a generally elongated and three dimensional rectangular and rigid self-supporting body constructed from a flattened blank construction including a plurality of hinged panels defining each of a front panel, a back panel, a top panel, a bottom panel and side panels, said body adapted for holding a set of clothing, including footwear, said top panel further having first and second pairs of side and end flaps assembleable in order to define an upper most lip;

said front panel further including an inner perimeter extending edge separating an outer frame portion with an access opening to an interior of said body;

a door hingedly secured along a forward edge of the body and being releasably engaged over an open front of the locker in order to cover the access opening;

a hanger adapted to being supported relative to a top structurally supporting underside location of the open interior, said structurally supporting underside further including a plurality of folded inter-hinged and assembleable portions projecting from a top location of said inner perimeter extending edge in said front panel, upon assembly of said inter-hinged and assembleable portions, an insertion slot being defined in one of said inter-hinged portions which is adapted to receive an upper hooked end of the hanger:

said body further including a hanging aperture configured within said upper most lip of said body, said aperture adapted for suspending said body from a horizontally extending pole;

said hanging aperture further including spaced apart extending edge surfaces, each edge surface having vertical and horizontal connecting portions; and said door being opened and closed with said body in either of bottom supported or suspended positions.

7. The clothing locker as described in claim 6, further comprising hook and loop fastener portions for releasably securing said door to said body.

8. The clothing locker as described in claim 6, further comprising ventilation apertures along said side panels of said body.

9. An authority controlled clothing locker, comprising:

a generally elongated and three dimensional rectangular body constructed of a rigid paperboard material and which is adapted for holding a set of clothing, including footwear;

a front panel of said body including an inner perimeter extending edge separating an outer frame portion with an access opening to an interior of said body:

a door hingedly secured along a forward and height extending edge of the body and openable to access the interior, said door being releasably engaged over said front panel of said assembled body to close access to the interior;

a hanger adapted to being supported relative to a top structurally supporting underside location of the open interior, said structurally supporting underside further including plurality of folded inter-hinged and assembleable portions projecting from a top location of said inner perimeter extending edge in said front panel, upon assembly of said inter-hinged and assembleable portions, an insertion slot being defined in one of said inter-hinged portions which is adapted to receive an upper hooked end of the hanger;

said body further including a hanging aperture configured within an upper most lip of said body, said aperture adapted for suspending said body from a horizontally extending pole; and said door being opened and closed with said body in either of bottom supported or suspended positions.

10. The clothing locker as described in claim 9, said body further comprising a flattened blank construction including a plurality of hinged panels defining each of said front panel, in addition to a back panel, a top panel, a bottom panel and side panels.

11. The clothing locker as described in claim 10, said top panel further comprising first and second pairs of side and end flaps assembleable in order to define said upper most lip.

12. The clothing locker as described in claim 11, said hanging aperture further including spaced apart extending edge surfaces, each edge surface having vertical and horizontal connecting portions.

13. The clothing locker as described in claim 10, further comprising hook and loop fastener portions for releasably securing said door to said body.

14. The clothing locker as described in claim 10, further comprising ventilation apertures along said side panels of said body.

* * * * *